US010405643B2

(12) United States Patent
Wu

(10) Patent No.: US 10,405,643 B2
(45) Date of Patent: Sep. 10, 2019

(54) ORAL CARE IMPLEMENT

(71) Applicant: COLGATE-PALMOLIVE COMPANY, New York, NY (US)

(72) Inventor: Donghui Wu, Bridgewater, NJ (US)

(73) Assignee: Colgate-Palmolive Company, New York, NY (US)

( * ) Notice: Subject to any disclaimer, the term of this patent is extended or adjusted under 35 U.S.C. 154(b) by 137 days.

(21) Appl. No.: 15/504,445

(22) PCT Filed: Aug. 18, 2014

(86) PCT No.: PCT/US2014/051485
§ 371 (c)(1),
(2) Date: Feb. 16, 2017

(87) PCT Pub. No.: WO2016/028259
PCT Pub. Date: Feb. 25, 2016

(65) Prior Publication Data

US 2017/0231379 A1 Aug. 17, 2017

(51) Int. Cl.

| | |
|---|---|
| ***A46B 11/00*** | (2006.01) |
| ***B05B 11/00*** | (2006.01) |
| ***A46B 9/04*** | (2006.01) |

(52) U.S. Cl.
CPC ..... *A46B 11/0041* (2013.01); *A46B 9/04* (2013.01); *A46B 11/002* (2013.01); *A46B 11/0058* (2013.01); *B05B 11/3032* (2013.01); *B05B 11/3033* (2013.01); *B05B 11/3036* (2013.01); *B05B 11/3064* (2013.01); *A46B 2200/1066* (2013.01)

(58) Field of Classification Search
CPC ..... A46B 11/0041; B05B 11/3033; B05B 11/3036; B05B 11/3071
USPC ..... 401/145, 184, 187; 222/209, 212, 213, 222/214, 215, 380; 137/522, 528, 845, 137/851, 852, 854; 417/374, 478, 479
See application file for complete search history.

(56) References Cited

U.S. PATENT DOCUMENTS 3,141,580 A 7/1964 Rogers
3,244,332 A 4/1966 Rogers
(Continued)

FOREIGN PATENT DOCUMENTS

GB 2386828 A 10/2003

OTHER PUBLICATIONS

International Search Report and the Written Opinion of the International Searching Authority issued in international application PCT/US2014/051485 dated Apr. 18, 2015.

*Primary Examiner* — David J Walczak
*Assistant Examiner* — Joshua R Wiljanen

(57) ABSTRACT

An oral care implement comprises a handle having a container containing oral care fluid, A head includes tooth cleaning elements and a fluid outlet to output fluid into the vicinity thereof. A manually actuatable pump mechanism in the handle between the container and fluid outlet is connected thereto by respective first and second conduits. The pump mechanism comprises a chamber having an inlet connected to the first conduit, an outlet connected to the second conduit, and an actuatable valve mechanism for selectively opening the inlet and outlet respectively to cause fluid flow into and out of the chamber. The mechanism comprises first and second valve elements and a deformable actuator connected to the first and second valve elements. A wall which defines at least a part of the chamber is adapted to be manually moved to operate the valve mechanism.

20 Claims, 5 Drawing Sheets

(56) References Cited

U.S. PATENT DOCUMENTS

| | | | |
|---|---|---|---|
| 4,984,923 | A | 1/1991 | Ota |
| 5,871,297 | A | 2/1999 | Rogers et al. |
| 6,257,791 | B1 | 7/2001 | Scamard |
| 6,406,207 | B1 | 6/2002 | Wiegner |
| 2005/0035157 | A1 | 2/2005 | Brennan et al. |
| 2009/0119859 | A1 | 5/2009 | Podolsky |
| 2010/0284726 | A1 | 11/2010 | Ottaviani et al. |
| 2011/0076090 | A1 | 3/2011 | Wu et al. |
| 2012/0097709 | A1 | 4/2012 | Han de Man et al. |
| 2012/0210528 | A1 | 8/2012 | Wicks |
| 2012/0288320 | A1 | 11/2012 | Barkhordar |
| 2013/0308994 | A1 | 11/2013 | Wu et al. |

ORAL CARE IMPLEMENT

BACKGROUND

The present invention relates to an oral care implement. In particular, the present invention relates to an oral care implement which is capable of delivering an oral care fluid, such as a liquid formulation, for example a mouthwash or mouth rinse, into the oral cavity of a user.

It is known to provide a variety of different toothbrush configurations in which a substance is stored with the toothbrush for delivery to the head.

The present invention aims to provide an oral care implement which can reliably store a fluid active, for subsequent delivery to the head, under a variety of different environmental conditions of varying atmospheric pressure and/or ambient temperature without inadvertent leakage of the fluid from the oral care implement or inadvertent contamination of the stored fluid active.

The present invention further aims to provide such an oral care implement which can reliably store a free-flowing liquid active without inadvertent leakage of the liquid from the oral care implement.

The present invention further aims to provide such an oral care implement which can be manufactured at low cost.

The present invention further aims to provide such an oral care implement which can provide a controlled dose of the fluid active to the head.

BRIEF SUMMARY

The present invention provides an oral care implement comprising a handle portion, a container located in the handle portion and containing an oral care fluid, a head portion including a plurality of tooth cleaning elements, a fluid outlet in the head portion for outputting the oral care fluid into the vicinity of at least one of the tooth cleaning elements, and a manually actuatable pump mechanism is located in the handle portion between the container and the fluid outlet, the pump mechanism being connected to the container and the fluid outlet by respective first and second conduits, wherein the pump mechanism comprises a chamber having an inlet connected to the first conduit and an outlet connected to the second conduit, an actuatable valve mechanism for selectively opening the inlet and outlet respectively to cause fluid flow into the chamber from the first conduit and out of the chamber into the second conduit, the actuatable valve mechanism comprising a first valve element for selectively closing or opening the inlet, a second valve element for selectively opening or closing the outlet and a deformable actuator connected to the first and second valve elements, and a wall which defines at least a part of the chamber and is adapted to be manually moved to operate the actuatable valve mechanism.

Optionally, the wall which defines at least part of the chamber is a flexible wall adapted to be manually flexed to operate the actuatable valve mechanism.

Optionally, the oral care implement further comprise a neck portion connecting the head portion to the handle portion, the second conduit extending through the neck portion. Further optionally, the second conduit is integrally formed in the neck portion. The pump mechanism may optionally be located at an end of the handle portion adjacent to the neck portion.

Optionally, when the pump mechanism is manually actuated the volume of the chamber is reduced causing fluid therein to be pumped into the second conduit from the chamber.

Optionally, when the pump mechanism is not manually actuated the inlet is open and the outlet is sealed, and when the pump mechanism is manually actuated the inlet is sealed and the outlet is open.

Optionally, the pump mechanism is located at a location on the handle portion adapted to receive the thumb of a user. Further optionally, the wall has an outer surface located and configured to be engaged by the thumb of a user when holding the handle portion for brushing teeth.

Optionally, the actuatable valve mechanism is adapted to move between an intake position in which the inlet is open and the outlet is closed and an active discharge, fluid delivery, position in which the outlet is open, the inlet is closed and fluid pressure in the chamber causes fluid flow out of the chamber through the outlet and into the second conduit.

Optionally, the deformable actuator is coupled to the wall.

Optionally, the first valve element is located within the chamber and opens the inlet by being moved away from the inlet towards a center of the chamber and the second valve element is located externally of the chamber and opens the outlet by being moved away from the outlet and the chamber. Further optionally, the deformable actuator comprises a compressible and expandable mechanism, the first and second valve elements being mounted at respective longitudinal ends of the deformable actuator. Yet further optionally, the deformable actuator is movable between an expanded first position, in which the inlet is opened by the first valve element and the outlet is closed by the second valve element, and a compressed second position, in which the inlet is closed by the first valve element and the outlet is opened by the second valve element. Still further optionally, the deformable actuator is movable by manual actuation from the expanded first position to the compressed second position, and is movable by a self-biasing actuation from the compressed second position to the expanded first position. Optionally, the expanded first position and the compressed second position constitute the lateral expansion and compression of the deformable actuator, and when the deformable actuator is laterally expanded the longitudinal ends of the deformable actuator are retracted longitudinally towards each other and when the deformable actuator is laterally compressed the longitudinal ends of the deformable actuator are extended longitudinally away from each other.

Optionally, the deformable actuator comprises a spring mechanism comprising a diamond-shaped frame having a first pair of laterally opposite apexes and a second pair of longitudinally opposite apexes, the laterally opposite apexes respectively engaging the wall and a further wall of the chamber and the longitudinally opposite apexes being respectively coupled to the first and second valve elements. Typically, the spring mechanism is composed of stainless steel, acetal, polyetherimide, nylon, polyester, polycarbonate, HDPE, polypropylene, or other resilient polymeric material.

Optionally, the diamond-shaped frame is configured whereby movement of the first pair of laterally opposite apexes towards each other, against a spring bias, by inward movement or deformation of the wall so as to reduce the volume of the chamber causes movement of the second pair of longitudinally opposite apexes away from each other. Further optionally, the second pair of longitudinally opposite apexes move away from each other from an initial sealing configuration which seals the outlet and opens the inlet to a final delivery configuration which opens the outlet and seals the inlet.

Optionally, the deformable actuator is mechanically fitted to a first coupling on an inner surface of the wall. Further optionally, the deformable actuator is mechanically fitted to a second coupling on an inner surface of the further wall.

Optionally, the further wall is flexible and can be manually flexed to operate the actuatable valve mechanism. Further optionally, the wall and the further wall are respective portions of a single flexible member defining the chamber.

Optionally, in some embodiments the first and second valve elements comprise flexible diaphragms. Further optionally, the flexible diaphragms are substantially part-spherical in an unstressed and unsealed state and substantially planar in a sealed state.

Optionally, in some embodiments the first and second valve elements are conical, a conical surface thereof being receivable in the respective inlet and outlet.

Optionally, the first and second valve elements are composed of thermoplastic elastomer.

Optionally, the pump mechanism is adapted to deliver a fluid dose volume of from 50 to 200 microliters by the manual actuation of the pump mechanism.

Optionally, the container has a volume of from 5 to 15 milliliters. Typically, the container comprises at least about 100 doses of the oral care fluid.

Optionally, the container comprises a flexible collapsible bag sealingly fitted to the first conduit.

The oral care fluid is a liquid and typically comprises a mouthwash or mouth rinse.

The present invention can provide, in some embodiments, a simple toothbrush design that is capable of delivering free-flowing liquid formulations (e.g. mouthwash) into user's oral cavity before, during or after normal brushing activity. The liquid formulation is transported by the user's action from the storage container located inside the toothbrush handle through the brush neck and head into user's oral cavity. Some embodiments of the present invention also enable the user to conveniently deliver, using the toothbrush, additional oral care active ingredients that are incompatible or unstable with toothpaste formulations. Some embodiments of the present invention also enable the user to conveniently delivery breath freshening solution or flavors or activators for functional ingredients in toothpaste, as well as diagnostic solutions that contain caries or plaque-disclosing agents. Furthermore, some embodiments of the present invention enable the user to conveniently delivery a pre-treatment solution before brushing, or a coating/sealant composition after brushing.

Some preferred embodiments of the present invention can provide an oral care implement which can reliably store a fluid active, for subsequent delivery to the head, under a variety of different environmental conditions of varying atmospheric pressure and/or ambient temperature without inadvertent leakage of the fluid from the oral care implement or inadvertent contamination of the stored fluid active.

The oral care implement of preferred embodiments of the present invention may reliably store a free-flowing liquid active without inadvertent leakage of the liquid from the oral care implement.

Furthermore, the oral care implement of preferred embodiments of the present invention may be manufactured at low cost.

In addition, the oral care implement of preferred embodiments of the present invention may provide a controlled dose of the fluid active to the head.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiments is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
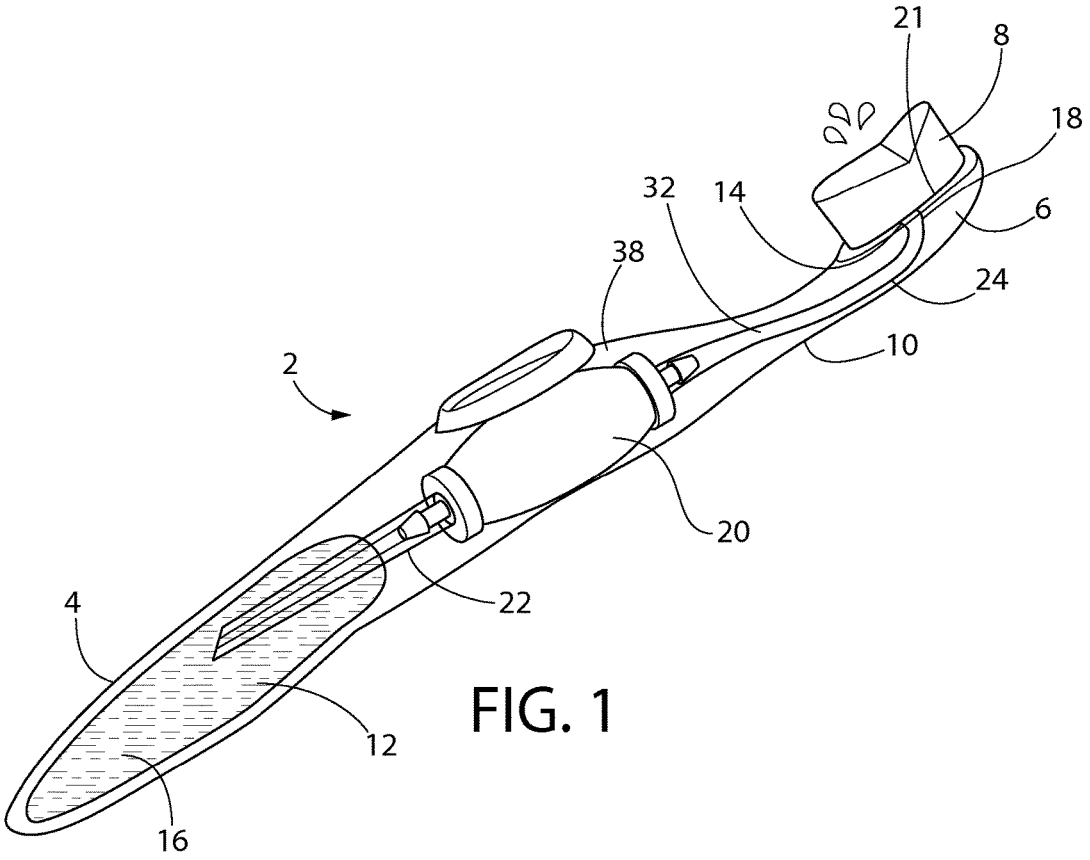
FIG. 1 is a schematic perspective view, partly in phantom, of an oral care implement in accordance with a first embodiment of the present invention.
Figure 2A:
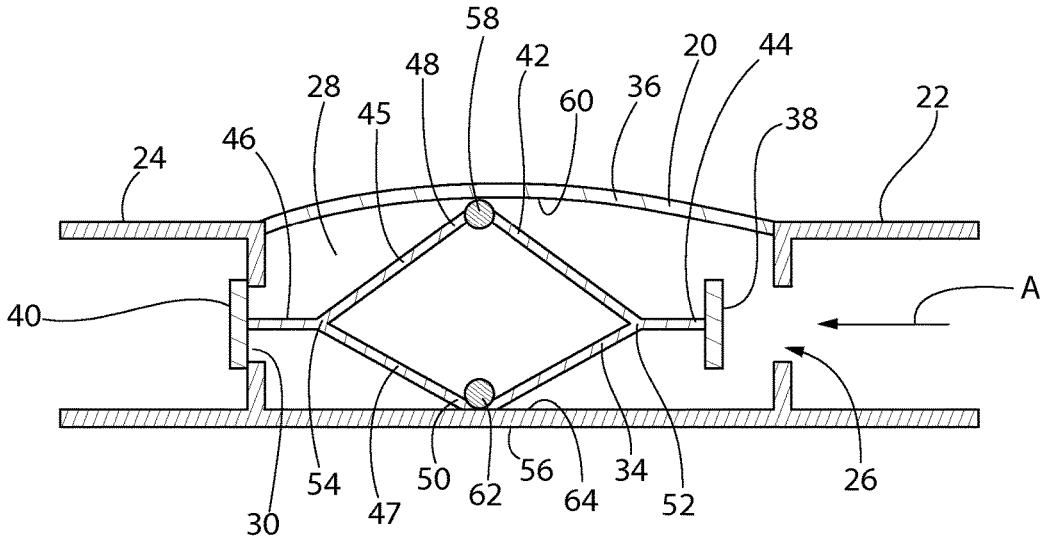
FIGS. 2A and 2B are schematic illustrations of the structure and function of a manually actuatable pump mechanism in the oral care implement of FIG. 1, FIG. 2A showing an intake configuration and FIG. 2B showing an active discharge, fluid delivery, configuration.
Figure 2B:
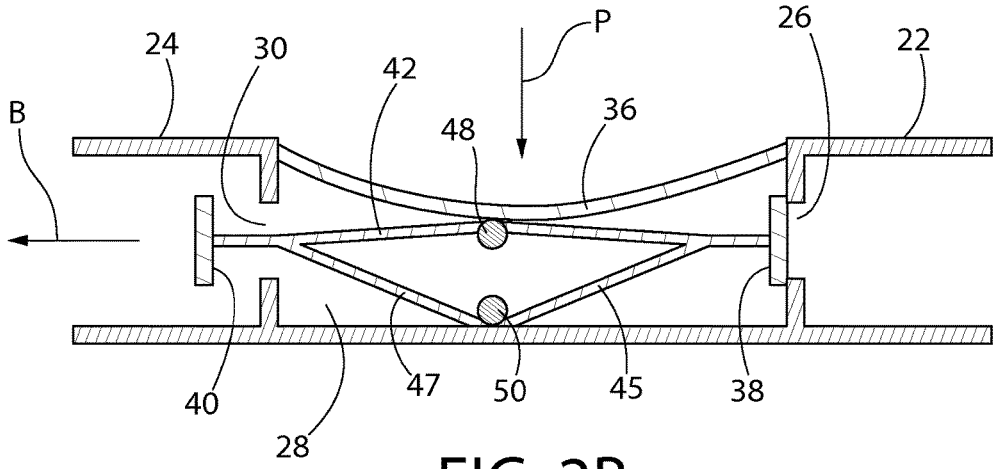

Referring to FIG. 1 and FIGS. 2A and 2B, there is shown an oral care implement 2 in accordance with a first embodiment of the present invention. The oral care implement 2 comprises a handle portion 4, a head portion 6 including a plurality of tooth cleaning elements 8, and a neck portion 10 connecting the head portion 6 to the handle portion 4. The tooth cleaning elements 8 may comprise any tooth cleaning elements 8 known for use in oral care implements, such as bristles or elastomeric cleaning elements or any mixture thereof. Typically, the oral care implement 2 is a toothbrush comprising bristles. The bristles may be mounted in the head portion 6 by any known technique, such as stapling or in-mold tufting (IFT) or anchor-free tufting (AFT).

The handle portion 4, neck portion 10 and head portion 6 are injection molded, and typically composed of polypropylene which is substantially rigid, although the narrowed neck portion 10 does provide some flexibility when brushing the teeth.

A container 12 is located in the handle portion 4. The container 12 contains an oral care fluid 16, such as a mouthwash or mouth rinse. Typically, the container 12 has a volume of from 5 to 15 milliliters, for example about 10 milliliters, and is filled with the oral care fluid 16. This typically provides about 100 doses of the oral care fluid 16. The container 12 preferably comprises a flexible collapsible bag. The container 12 may be composed of a polymer such as polyethylene. The container 12 may alternatively comprise a rigid and clear (see-through, transparent or translucent) cylinder with an airless piston (not shown), so that its content can be seen be users. The variable volume design of container 12 can avoid negative pressure build up when its content is being dispensed, while maintaining a leak-proof feature.

A fluid outlet 18 is located in the head portion 6. The fluid outlet 18 is configured for outputting the oral care fluid 16 into the vicinity of at least one of the tooth cleaning elements 8. Typically, the fluid outlet 18 comprises one or more openings 14 in the head portion 6 at a base 21 of one or more of the tooth cleaning elements 8.

A manually actuatable pump mechanism 20, schematically shown in FIG. 1, is located in the handle portion 4 between the container 12 and the fluid outlet 18. The pump mechanism 20 is connected to the container 12 and the fluid outlet 18 by respective first and second conduits 22, 24. The container 12 is sealingly fitted to the first conduit 22 which extends through the handle portion 4. The second conduit 24 extends through the neck portion 10. The second conduit 24 is connected to the fluid outlet 18.

The second conduit 24 may be integrally formed in the neck portion 10, or alternatively, as shown in FIG. 1, may comprise tube element 32 located within the neck portion 10.

The pump mechanism 20 is located at an end 38 of the handle portion 4 which is adjacent to the neck portion 10. The pump mechanism 20 is located at a location on the handle portion 4 adapted to receive the thumb of a user.

Referring to FIGS. 2A and 2B, the first conduit 22 is connected to an inlet 26 of a chamber 28 comprised in the pump mechanism 20. The second conduit 24 is connected to an outlet 30 of the chamber 28.

The pump mechanism 20 further comprises an actuatable valve mechanism 34 for selectively opening the inlet 26 and outlet 30 respectively to cause fluid flow into the chamber 28 from the first conduit 22, represented by arrow A, and out of the chamber 28 into the second conduit 24, represented by arrow B. The pump mechanism 20 further comprises a wall 36, which may be a flexible wall, and which defines at least a part of the chamber 28 and is adapted to be manually moved or flexed to operate the actuatable valve mechanism 34. The flexible wall 36 is typically composed of a thermoplastic elastomer.

The flexible wall 36 has an outer surface located and configured to be engaged by the thumb of a user when holding the handle portion 4 for brushing the teeth of the user.

The flexible wall 36 may have an exposed outer surface, as shown schematically in FIGS. 2A and 2B, or may be covered by a further flexible sheet (not shown), in either case the flexible wall 36 defining a push button, in the form of a flexible diaphragm, for manual operation of the pump mechanism 20, in particular being thumb-operated.

When the pump mechanism 20 is manually actuated the volume of the chamber 28 is reduced causing fluid therein to be pumped into the second conduit 24 from the chamber 28. When the pump mechanism 20 is not manually actuated the inlet 26 is open and the outlet 30 is sealed. When the pump mechanism 20 is manually actuated the inlet 26 is sealed and the outlet 30 is open.

The actuatable valve mechanism 34 is adapted to move between an intake position in which the inlet 26 is open and the outlet 30 is closed and an active discharge, fluid delivery, position in which the outlet 30 is open, the inlet 26 is closed and fluid pressure in the chamber 28 causes fluid flow out of the chamber 28 through the outlet 30 and into the second conduit 24.

The actuatable valve mechanism 34 comprises a first valve element 38 for selectively closing or opening the inlet 26 and a second valve element 40 for selectively opening or closing the outlet 30. Typically, the first and second valve elements 38, 40 are composed of thermoplastic elastomer. A deformable actuator 42 of the actuatable valve mechanism 34 is connected to the first and second valve elements 38, 40. The deformable actuator 42 is also coupled to the flexible wall 36.

The first valve element 38 is located within the chamber 28 and opens the inlet 26 by being moved away from the inlet 26 towards a center of the chamber 28. The second valve element 40 is located externally of the chamber 28 and opens the outlet 30 by being moved away from the outlet 30 and the chamber 28.

The deformable actuator 42 comprises a compressible and expandable mechanism. The first and second valve elements 38, 40 are mounted at respective longitudinal ends 44, 46 of the deformable actuator 42. The deformable actuator 42 is movable between an expanded position, shown in FIG. 2A, in which the inlet 26 is opened by the first valve element 38 and the outlet 30 is closed by the second valve element 40, and a compressed position, shown in FIG. 2B, as a result of pressure being applied as represented by arrow P, in which the inlet 26 is closed by the first valve element 38 and the outlet 30 is opened by the second valve element 40. The deformable actuator 42 is movable by manual actuation from the expanded position to the compressed position, and is movable by a self-biasing actuation from the compressed position to the expanded position. The expanded and compressed positions constitute the lateral expansion and compression of the deformable actuator 42; when the deformable actuator 42 is laterally expanded the longitudinal ends 44, 46 of the deformable actuator 42 are retracted longitudinally towards each other and when the deformable actuator 42 is laterally compressed the longitudinal ends 44, 46 of the deformable actuator 42 are extended longitudinally away from each other.

The deformable actuator 42 comprises a spring mechanism 45 comprising a diamond-shaped frame 47 having a first pair of laterally opposite apexes 48, 50 and a second pair of longitudinally opposite apexes 52, 54. The diamond-shaped frame 47 has a structure and function similar to a "scissor-jack". The laterally opposite apexes 48, 50 respectively engage the flexible wall 36 and a further wall 56 of the chamber 28.

In the embodiment of FIG. 1 and FIGS. 2A and 2B the further wall 56 is rigid and comprises a part of the handle portion 4.

The deformable actuator 42, in particular one laterally opposite apex 48, is mechanically fitted to a first coupling 58 on an inner surface 60 of the flexible wall 36. Also, the deformable actuator 42, in particular the other laterally opposite apex 50, is mechanically fitted to a second coupling 62 on an inner surface 64 of the further wall 56. The first and second couplings 58, 60 may be snap-fit or compression-fit couplings. Alternatively, any other type of connection, bonding or adhesion may be employed.

The longitudinally opposite apexes 52, 54 are respectively coupled to the first and second valve elements 38, 40. Typically, the spring mechanism 45 is composed of stainless steel, acetal, polyetherimide, nylon, polyester, polycarbonate, HDPE, polypropylene, or any other resilient polymeric material, although other resilient materials may be employed.

The diamond-shaped frame 47 is configured whereby movement of the first pair of laterally opposite apexes 48, 50 towards each other, against a spring bias, by inward deformation of the flexible wall 36 so as to reduce the volume of the chamber 28 causes movement of the second pair of longitudinally opposite apexes 52, 54 away from each other. The second pair of longitudinally opposite apexes 52, 54 move away from each other from an initial sealing configuration, shown in FIG. 2A, which seals the outlet 30 and opens the inlet 26, to a final delivery configuration, shown in FIG. 2B, which opens the outlet 30 and seals the inlet 26.

As shown in FIG. 2A, in the intake position the inlet 26 is open and the outlet 30 is closed. This means that any bacteria or other contamination in the second conduit as a result of use of the oral care implement is prevented from entering the chamber 28 and the container 12. The fluid amounts in the chamber 28 and the container 12 are in communication via the inlet 26 and at the same pressure As shown in FIG. 2B, when the flexible wall 36 is manually depressed to move or deform inwardly to reduce the volume of the chamber 28, in the resultant active discharge, fluid delivery, position the outlet 30 is opened and the inlet 26 is closed. The increased fluid pressure in the chamber 28 causes fluid flow out of the chamber 28 through the outlet 30 and into the second conduit 24 to deliver the fluid to the tooth cleaning elements 8.

The pump mechanism 20 is adapted to deliver a typical fluid dose volume of from 50 to 200 microliters by the manual actuation of the pump mechanism 20.

When the flexible wall 36 is manually released, the spring bias of the diamond-shaped frame 47 returns the pump mechanism 20 to the configuration shown in FIG. 2A, and further oral care fluid is sucked into the chamber 28 from the container 12 when the inlet 26 is opened as a result of a negative pressure generated in the chamber 28 by expansion of the chamber 28 on returning to the expanded intake position.

When the user singly, or repeatedly, depresses and releases the flexible wall 36, the pump mechanism 20 is operated and the diamond-shaped frame 47, functioning similar to a "scissor-jack", is compressed and expanded to deliver oral care fluid to the head portion 6 and therefrom into the user's oral cavity. At the rest position, i.e. with no user activation, the pump mechanism 20 is at the configuration shown in FIG. 2A—the outlet valve is in its closed position so that oral care fluid will not leak out from the pump chamber 28 and storage container 12.

When there is a negative pressure outside the oral care implement, e.g. when the toothbrush is travelling in an airplane at significant altitude with lower cabin air pressure, or the toothbrush is being stored or transported in a high temperature environment so that the oral care fluid creates increased pressure due to evaporation, the "scissor-jack" would be laterally expanded due to the expansion of the flexible wall 36 which functions as a diaphragm, and thereby longitudinally retract the first and second valve elements 38, 40. Such retraction would in turn exert an additional sealing force on the outlet valve to provide an enhanced seal and prevent fluid leakage from the chamber 28.

In contrast, when there is a positive outside pressure, e.g. the toothbrush is being stored or transported in a low temperature environment, the opposite would happen to the "scissor-jack", namely the "scissor-jack" would be laterally contracted due to the compression of the flexible wall 36 which functions as a diaphragm, and thereby longitudinally extend the first and second valve elements 38, 40. Such extension would in turn exert an additional sealing force on the inlet valve to provide an enhanced seal and prevent fluid leakage from the storage container 12. A small amount of oral care fluid, which is already inside the pump chamber 28, may be discharged at the head portion 8 in such a low pressure environment.

Figure 3A:
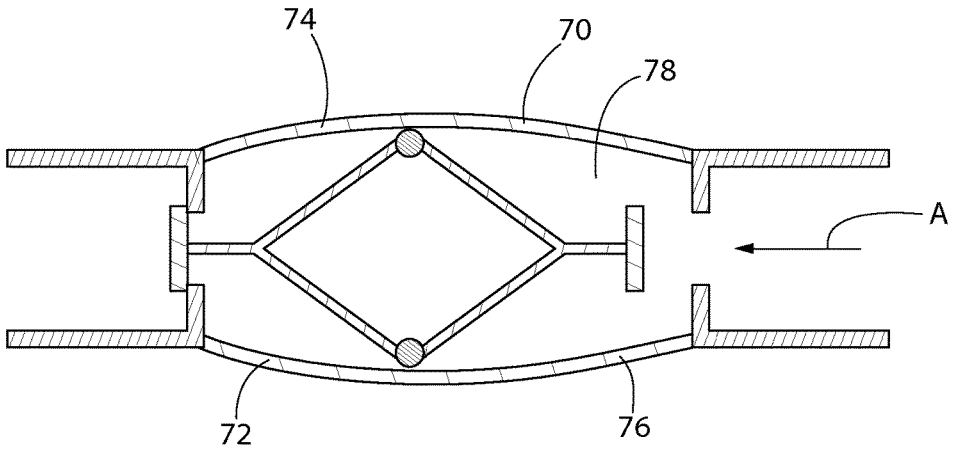
FIGS. 3A and 3B are schematic illustrations of the structure and function of a manually actuatable pump mechanism in an oral care implement in accordance with a second embodiment of the present invention, FIG. 3A showing an intake configuration and FIG. 3B showing an active discharge, fluid delivery, configuration.
Figure 3B:
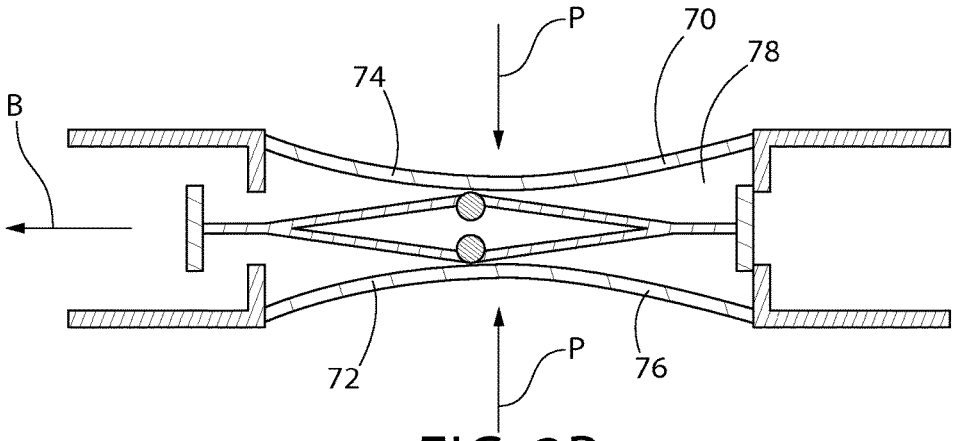

Referring to FIGS. 3A and 3B, there is shown a pump mechanism 70 of an oral care implement in accordance with a second embodiment of the present invention. This embodiment is modified as compared to the first embodiment by providing that the further wall 72, opposite to the flexible wall 74, is also flexible and can be manually flexed to operate the actuatable valve mechanism. Typically in this embodiment the flexible wall 74 and the further wall 72 are respective portions of a single flexible member 76 defining the chamber 78. In use, the single flexible member 76 is manually compressed inwardly by being squeezed so as to move the pump mechanism 70 from the expanded intake position shown in FIG. 3A to the compressed active discharge, fluid delivery, position shown in FIG. 3B. Otherwise the oral care implements of the first and second embodiments are the same and reference is made to the description of the first embodiment for the structure and function of the second embodiment.

Figure 4A:
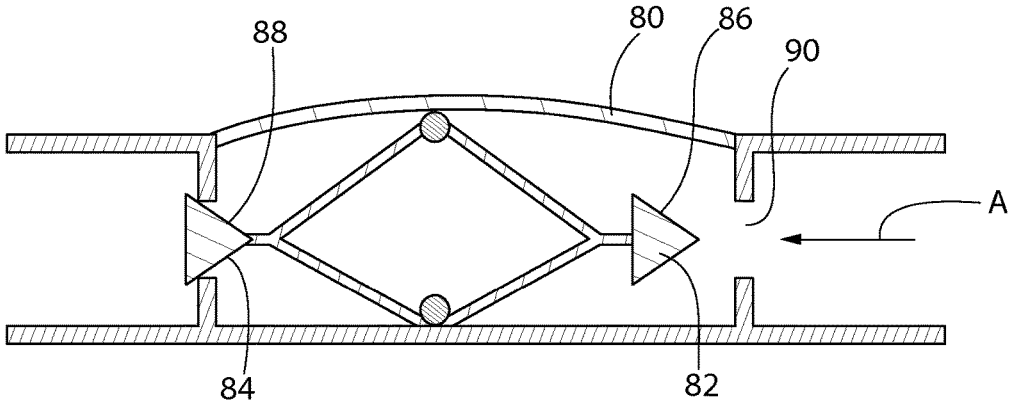
FIGS. 4A and 4B are schematic illustrations of the structure and function of a manually actuatable pump mechanism in an oral care implement in accordance with a third embodiment of the present invention, FIG. 4A showing an intake configuration and FIG. 4B showing an active discharge, fluid delivery, configuration.
Figure 4B:
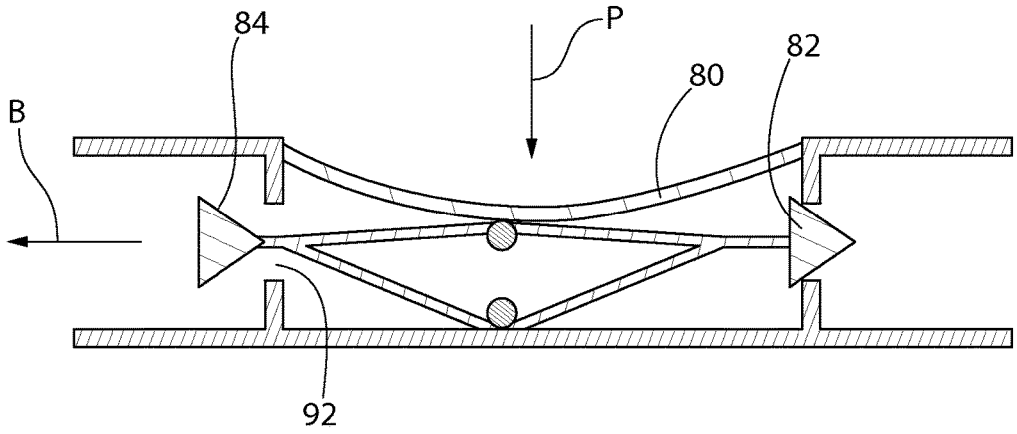

Referring to FIGS. 4A and 4B, there is shown a pump mechanism 80 of an oral care implement in accordance with a third embodiment of the present invention. This embodiment is modified as compared to the first embodiment by providing that the first and second valve elements 82, 84 are conical, a conical surface 86, 88 thereof being receivable in the respective inlet 90 and outlet 92. The conical valve mechanisms can provide enhanced self-alignment of valve elements into the respective openings. Otherwise the oral care implements of the first and third embodiments are the same and reference is made to the description of the first embodiment for the structure and function of the third embodiment. The valve elements in the third embodiment may alternatively be used in the oral care implement of the second embodiment.

Figure 5A:
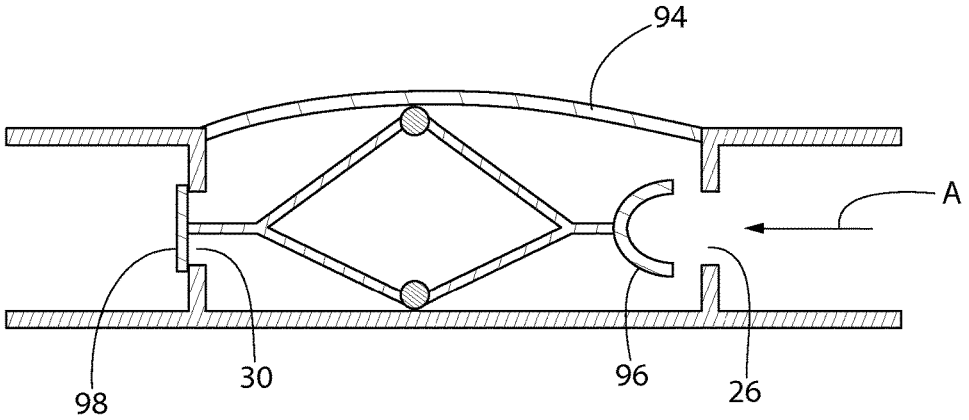
FIGS. 5A and 5B are schematic illustrations of the structure and function of a manually actuatable pump mechanism in an oral care implement in accordance with a fourth embodiment of the present invention, FIG. 5A showing an intake configuration and FIG. 5B showing an active discharge, fluid delivery, configuration.
Figure 5B:
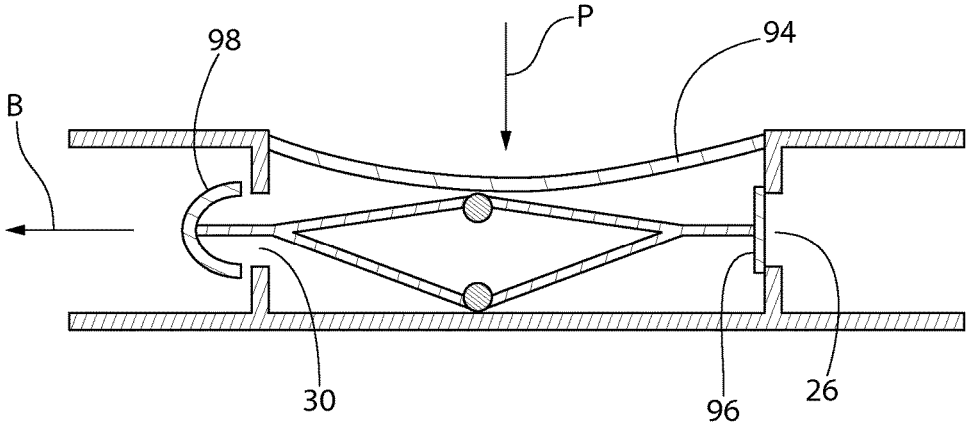

Referring to FIGS. 5A and 5B, there is shown a pump mechanism 94 of an oral care implement in accordance with a fourth embodiment of the present invention. This embodiment is modified as compared to the first embodiment by providing that the first and second valve elements 96, 98 comprise flexible diaphragms which are substantially part-spherical in an unstressed and unsealed state and substantially planar in the sealed state. Such a configuration provides some degree of travel for the valve elements before opening the respective inlet 26 or outlet 30. This will result that both valves are at a closed position during the initial stage of activation to minimize leakage and contamination, and increased pumping efficacy. Otherwise the oral care implements of the first and fourth embodiments are the same and reference is made to the description of the first embodiment for the structure and function of the fourth embodiment. The valve elements in the fourth embodiment may alternatively be used in the oral care implement of the second embodiment.

The valve element structure of any of the first to fourth embodiments may be combined to provide any one of the valve element structures for the first valve element and any other of the valve element structures for the second valve element.

Various other modifications of the embodiments of the present invention will readily be apparent to those skilled in the art and are encompassed within the scope of the invention as defined in the appended claims.

What is claimed is:

1. An oral care implement comprising:

a handle portion, a container located in the handle portion and containing an oral care fluid;

a head portion including a plurality of tooth cleaning elements, a fluid outlet in the head portion for outputting the oral care fluid into the vicinity of at least one of the tooth cleaning elements; and a manually actuatable pump mechanism located in the handle portion between the container and the fluid outlet, the pump mechanism being connected to the container and the fluid outlet by respective first and second conduits;

wherein the pump mechanism comprises a chamber having an inlet connected to the first conduit and an outlet connected to the second conduit, an actuatable valve mechanism for selectively opening the inlet and outlet respectively to cause fluid flow into the chamber from the first conduit and out of the chamber into the second conduit, the actuatable valve mechanism comprising a first valve element for selectively closing or opening the inlet, a second valve element for selectively opening or closing the outlet and a deformable actuator connected to the first and second valve elements, and a wall which defines at least a part of the chamber and is adapted to be manually moved to operate the actuatable valve mechanism;

wherein the deformable actuator has longitudinal ends and is movable from an expanded position to a compressed position; and wherein when the deformable actuator is moved from the compressed position to the expanded position, the longitudinal ends are retracted longitudinally towards each other and when the deformable actuator is moved from the expanded position to the compressed position, the longitudinal ends are extended longitudinally away from each other.

2. The oral care implement of claim 1 wherein the wall is flexible and adapted to be manually flexed to operate the actuatable valve mechanism.

3. The oral care implement of claim 1 wherein when the pump mechanism is manually actuated the volume of the chamber is reduced causing fluid therein to be pumped into the second conduit from the chamber.

4. The oral care implement of claim 1 wherein when the pump mechanism is not manually actuated the inlet is open and the outlet is sealed, and when the pump mechanism is manually actuated the inlet is sealed and the outlet is open.

5. The oral care implement of claim 1 wherein the pump mechanism is located at a location on the handle portion adapted to receive the thumb of a user.

6. The oral care implement of claim 5 wherein the wall has an outer surface located and configured to be engaged by the thumb of a user when holding the handle portion for brushing teeth.

7. The oral care implement of claim 1 wherein the deformable actuator is coupled to the wall.

8. The oral care implement of claim 1 wherein the first valve element is located within the chamber and opens the inlet by being moved away from the inlet towards a center of the chamber and the second valve element is located externally of the chamber and opens the outlet by being moved away from the outlet and the chamber.

9. The oral care implement of claim 8 wherein the deformable actuator comprises a compressible and expandable mechanism, the first and second valve elements being mounted at the respective longitudinal ends of the deformable actuator.

10. The oral care implement of claim 9 wherein when the deformable actuator is moved between the expanded position the inlet is opened by the first valve element and the outlet is closed by the second valve element, and when the deformable actuator is moved to the compressed second position the inlet is closed by the first valve element and the outlet is opened by the second valve element.

11. The oral care implement of claim 1 wherein the first and second valve elements comprise flexible diaphragms, and wherein the flexible diaphragms are substantially part-spherical in an unstressed and unsealed state and substantially planar in a sealed state.

12. The oral care implement of claim 1 wherein the first and second valve elements are conical, a conical surface thereof being receivable in the respective inlet and outlet.

13. An oral care implement comprising:

a handle portion, a container located in the handle portion and containing an oral care fluid;

a head portion including a plurality of tooth cleaning elements, a fluid outlet in the head portion for outputting the oral care fluid into the vicinity of at least one of the tooth cleaning elements; and a manually actuatable pump mechanism located in the handle portion between the container and the fluid outlet, the pump mechanism being connected to the container and the fluid outlet by respective first and second conduits;

wherein the pump mechanism comprises a chamber having an inlet connected to the first conduit and an outlet connected to the second conduit, an actuatable valve mechanism for selectively opening the inlet and outlet respectively to cause fluid flow into the chamber from the first conduit and out of the chamber into the second conduit, the actuatable valve mechanism comprising a first valve element for selectively closing or opening the inlet, a second valve element for selectively opening or closing the outlet and a deformable actuator connected to the first and second valve elements, and a wall which defines at least a part of the chamber and is adapted to be manually moved to operate the actuatable valve mechanism;

wherein the first valve element is located within the chamber and opens the inlet by being moved away from the inlet towards a center of the chamber and the second valve element is located externally of the chamber and opens the outlet by being moved away from the outlet and the chamber;

wherein the deformable actuator comprises a compressible and expandable mechanism, the first and second valve elements being mounted at respective longitudinal ends of the deformable actuator;

wherein the deformable actuator is movable between an expanded first position, in which the inlet is opened by the first valve element and the outlet is closed by the second valve element, and a compressed second position, in which the inlet is closed by the first valve element and the outlet is opened by the second valve element; and wherein the expanded first position and the compressed second position constitute the lateral expansion and compression of the deformable actuator, and when the deformable actuator is laterally expanded the longitudinal ends of the deformable actuator are retracted longitudinally towards each other and when the deformable actuator is laterally compressed the longitudinal ends of the deformable actuator are extended longitudinally away from each other.

14. An oral care implement comprising:

a handle portion, a container located in the handle portion and containing an oral care fluid;

a head portion including a plurality of tooth cleaning elements, a fluid outlet in the head portion for outputting the oral care fluid into the vicinity of at least one of the tooth cleaning elements; and a manually actuatable pump mechanism located in the handle portion between the container and the fluid outlet, the pump mechanism being connected to the container and the fluid outlet by respective first and second conduits;

wherein the pump mechanism comprises a chamber having an inlet connected to the first conduit and an outlet connected to the second conduit, an actuatable valve mechanism for selectively opening the inlet and outlet respectively to cause fluid flow into the chamber from the first conduit and out of the chamber into the second conduit, the actuatable valve mechanism comprising a first valve element for selectively closing or opening the inlet, a second valve element for selectively opening or closing the outlet and a deformable actuator connected to the first and second valve elements, and a wall which defines at least a part of the chamber and is adapted to be manually moved to operate the actuatable valve mechanism;

wherein the deformable actuator comprises a spring mechanism comprising a diamond-shaped frame having a first pair of laterally opposite apexes and a second pair of longitudinally opposite apexes, the laterally opposite apexes respectively engaging the wall and a further wall of the chamber and the longitudinally opposite apexes being respectively coupled to the first and second valve elements.

15. The oral care implement of claim 14 wherein the spring mechanism is composed of stainless steel, acetal, polyetherimide, nylon, polyester, polycarbonate, HDPE, polypropylene, or other resilient polymeric material.

16. The oral care implement of claim 14 wherein the diamond-shaped frame is configured whereby movement of the first pair of laterally opposite apexes towards each other, against a spring bias, by inward movement of the wall so as to reduce the volume of the chamber causes movement of the second pair of longitudinally opposite apexes away from each other.

17. The oral care implement of claim 16 wherein the second pair of longitudinally opposite apexes move away from each other from an initial sealing configuration which seals the outlet and opens the inlet to a final delivery configuration which opens the outlet and seals the inlet.

18. The oral care implement of claim 14 wherein the deformable actuator is mechanically fitted to a first coupling on an inner surface of the wall and to a second coupling on an inner surface of the further wall.

19. The oral care implement of claim 14 wherein the further wall is flexible and can be manually flexed to operate the actuatable valve mechanism.

20. The oral care implement of claim 19 wherein the wall and the further wall are respective portions of a single flexible member defining the chamber.

* * * * *